US012773018B2

(12) United States Patent
Rizk

(10) Patent No.: US 12,773,018 B2
(45) Date of Patent: Oct. 27, 2026

(54) SLEEP SACK WITH ATTACHABLE BLANKET

(71) Applicant: Buckle Me Baby Coats, LLC, North Andover, MA (US)

(72) Inventor: Dahlia Rizk, Windham, NH (US)

(73) Assignee: Buckle Me Baby Coats, LLC, North Andover, MA (US)

( * ) Notice: Subject to any disclaimer, the term of this patent is extended or adjusted under 35 U.S.C. 154(b) by 0 days.

(21) Appl. No.: 18/443,493

(22) Filed: Feb. 16, 2024

(65) Prior Publication Data

US 2024/0324698 A1 Oct. 3, 2024

Related U.S. Application Data

(63) Continuation-in-part of application No. 18/192,061, filed on Mar. 29, 2023, now abandoned.

(51) Int. Cl.
*A41B 13/06* (2006.01)
*A47G 9/06* (2006.01)

(52) U.S. Cl.
CPC ..... *A41B 13/06* (2013.01); *A47G 9/068* (2013.01)

(58) Field of Classification Search
CPC ..... A41D 11/00; A41D 13/005; A41D 13/04; A41D 15/00; A41D 15/04; A47G 9/064; A41B 13/06
See application file for complete search history.

(56) References Cited

U.S. PATENT DOCUMENTS 2,234,546 A 3/1941 Basch
2,528,677 A * 11/1950 Wilson ..... A41D 10/00 D2/713
2,598,462 A 5/1952 Strauss
2,744,253 A 5/1956 Freedman
2,915,758 A 12/1959 Kaufman
6,266,822 B1 * 7/2001 Joyce ..... A47G 9/083 2/69.5
9,003,564 B2 * 4/2015 Wynh ..... A41B 13/06 2/83
9,498,007 B2 11/2016 Rizk
9,516,902 B1 * 12/2016 Adani ..... A41B 13/06
2006/0236441 A1 * 10/2006 Johnson ..... A41B 13/06 2/69.5
2013/0007940 A1 1/2013 Ryerson

FOREIGN PATENT DOCUMENTS

FR 2779036 A1 12/1999

OTHER PUBLICATIONS

Amazon.com, Inc., London Fog Newborn Infant Baby Girl Boy Puffer Carbag Pram Bag Snowsuit Bunting, Mar. 28, 2023.

* cited by examiner

*Primary Examiner* — Katherine M Moran
(74) *Attorney, Agent, or Firm* — Intrinsic Law Corp.

(57) ABSTRACT

A garment configured for use with a child safety car seat. The garment includes a sleep sack having a front side, a back side, an upper portion, a lower portion, a neck opening, and first and second arm openings. One or more first fastener portions is/are attached to the sleep sack. The garment further includes a blanket having one or more blanket fastener portions attached thereto, the one or more blanket fastener portions releasably engaging the one or more first fasteners portions to form one or more respective clothing fasteners that releasably attach the blanket to the sleep sack.

19 Claims, 15 Drawing Sheets

SLEEP SACK WITH ATTACHABLE BLANKET

CROSS-REFERENCE TO RELATED APPLICATIONS

This application is a continuation-in-part of U.S. application Ser. No. 18/192,061, titled "Sleep Sack Configured for Child Safety Car Seats," filed on Mar. 29, 2023, which is hereby incorporated by reference.

TECHNICAL FIELD

This application relates generally to sleeps sack garments for young children.

BACKGROUND

Parents often place their young children in sleep sacks, which provide the warmth and comfort of a blanket while reducing the associated risk of suffocation. Though conventional sleep sacks have been designed with slits to provide access to the crotch buckle in child safety car seats, this design is not allowed by car-seat manufactures and is disapproved by child passenger safety experts due to safety concerns. Since conventional sleep sacks are not designed to be used safely in child safety car seats, parents either need to dress their children in extra layers or use blankets to keep their children warm in the car. Using blankets is undesirable due to the potential suffocation risks and the ability for the blanket to fall off the child.

Young children often fall asleep while cars are in motion. Parents may want a child that is asleep in a child safety car seat to be able to continue sleeping or napping in his/her crib while wearing a conventional sleep sack to reduce suffocation risks. However, this would require the parent to place and secure the sleeping child into the conventional sleep sack and risk waking the child.

Sleep sacks may not provide sufficient warmth for the child, for example during the winter. However, current guidelines do not allow loose blankets to be used with sleep sacks (or on their own) to reduce the likelihood of sudden infant death syndrome (SIDS).

SUMMARY

Example embodiments described herein have innovative features, no single one of which is indispensable or solely responsible for their desirable attributes. The following description and drawings set forth certain illustrative implementations of the disclosure in detail, which are indicative of several exemplary ways in which the various principles of the disclosure may be carried out. The illustrative examples, however, are not exhaustive of the many possible embodiments of the disclosure. Without limiting the scope of the claims, some of the advantageous features will now be summarized. Other objects, advantages and novel features of the disclosure will be set forth in the following detailed description of the disclosure when considered in conjunction with the drawings, which are intended to illustrate, not limit, the invention.

An aspect of the invention is directed to a garment configured for use with a child safety car seat, comprising a sleep sack having a front side, a back side, an upper portion, a lower portion, a neck opening, and first and second arm openings; one or more first fastener portions attached to the sleep sack; and a blanket having one or more blanket fastener portions attached thereto, the one or more blanket fastener portions releasably engaging the one or more first fasteners portions to form one or more respective clothing fasteners that releasably attach the blanket to the sleep sack.

In one or more embodiments, the one or more first fastener portions is/are attached to the front side of the sleep sack. In one or more embodiments, the sleep sack has a length is measured with respect to a first axis that extends from the upper portion to the lower portion, the sleep sack has a width that is measured with respect to a second axis that is orthogonal to the first axis, the first and second arm openings spaced apart with respect to the second axis, and the width of the blanket is approximately equal to the width of the sleep sack. In one or more embodiments, the width of the sleep sack tapers from the lower portion to the upper portion. In one or more embodiments, the length of the blanket is less than the length of the sleep sack. In one or more embodiments, a first end of the blanket is aligned with the first and second arm openings, and a second end of the blanket is aligned with a bottom of the lower portion of the sleep sack.

In one or more embodiments, the one or more respective clothing fasteners comprise at least one zipper, at least one set of hook-and-loop fasteners, at least one set of button fasteners, at least one set of magnetic fasteners, and/or at least one set of snap fasteners. In one or more embodiments, the upper portion is configured to cover a child's torso, the upper portion including the neck opening and the first and second arm openings, the lower portion includes first and second leg sacks that fully enclose the child's respective legs, the front side is configured to cover the child's anterior side, the back side is configured to cover the child's posterior side, and the garment further comprises a longitudinal zipper attached to the sleep sack, the longitudinal zipper extending along at least a portion of the upper portion of the front side, the lower portion of the front side, and the lower portion of the back side. In one or more embodiments, the sleep sack has a car-seat configuration in which the longitudinal zipper is open along the bottom portion of the front and back sides to expose a groin buckle when the child is sitting in the child safety car seat.

In one or more embodiments, the longitudinal zipper includes first and second sets of teeth, the first set of teeth is attached to (a) the first leg sack on the front and back sides and (b) the upper portion of the front side, and the second set of teeth is attached to (a) the second leg sack on the front and back sides and (b) the upper portion of the front side, whereby when the sleep sack is in the car-seat configuration, the child's legs can separate while remaining fully enclosed by the first and second leg sacks, respectively. In one or more embodiments, the sleep sack has a closed configuration in which the longitudinal zipper is fully closed, the closed configuration for when the child is not secured in the car seat. In one or more embodiments, the sleep sack has an open configuration in which the longitudinal zipper is fully opened to remove the child from the sleep sack and/or place the child in the sleep sack.

Another aspect of the invention is directed to a garment configured for use with a child safety car seat, comprising a sleep sack having a front side, a back side, an upper portion, a lower portion, a neck opening, and first and second arm openings, wherein: the upper portion is configured to cover a child's torso, the upper portion including the neck opening and the first and second arm openings, the lower portion includes first and second leg sacks that fully enclose the child's respective legs, the front side is configured to cover the child's anterior side, and the back side is configured to cover the child's posterior side. The garment further comprises a longitudinal zipper attached to the sleep sack, the longitudinal zipper extending along the bottom portion of the front side and the bottom portion of the back side; and one or more fastener portions attached to the sleep sack, the one or more fastener portions configured to releasably engage one or more respective blanket fastener portions on a blanket to form one or more respective clothing fasteners that releasably attach the blanket to the sleep sack.

In one or more embodiments, the upper portion includes shoulder openings that allow the child to be removed from the sleep sack and/or to be placed into the sleep sack. In one or more embodiments, the garment further comprises shoulder fasteners that close and open the shoulder openings. In one or more embodiments, the one or more respective clothing fasteners comprise at least one zipper, at least one set of hook-and-loop fasteners, at least one set of button fasteners, at least one set of magnetic fasteners, and/or at least one set of snap fasteners.

In one or more embodiments, the one or more fastener portions is/are one or more front fastener portions that are attached to the front side of the sleep sack, the one or more front fastener portions is/are configured to releasably engage one or more respective first blanket fastener portions on a first blanket to form one or more respective first clothing fasteners that releasably attach the first blanket to the front side of the sleep sack, and the garment further comprises one or more back fastener portions that is/are attached to the back side of the sleep sack, the one or more back fastener portions configured to releasably engage one or more respective second blanket fastener portions on a second blanket to form one or more respective second clothing fasteners that releasably attach the second blanket to the back side of the sleep sack.

In one or more embodiments, the one or more fastener portions is/are one or more front fastener portions that are attached to the front side of the sleep sack, the garment further comprises one or more back fastener portions that is/are attached to the back side of the sleep sack, the garment has a first configuration in which the one or more front fastener portions releasably engage the one or more respective blanket fastener portions on the blanket to form one or more respective first clothing fasteners that releasably attach the first blanket to the front side of the sleep sack, and the garment has a second configuration in which one or more back fastener portions releasably engage the one or more respective blanket fastener portions on the blanket to form one or more respective second clothing fasteners that releasably attach the blanket to the back side of the sleep sack.

Another aspect of the invention is directed to a kit comprising a garment configured for use with a child safety car seat, comprising a sleep sack having a front side, a back side, an upper portion, a lower portion, a neck opening, and first and second arm openings, wherein: the upper portion is configured to cover a child's torso, the upper portion including the neck opening and the first and second arm openings, the lower portion includes first and second leg sacks that fully enclose the child's respective legs, the front side is configured to cover the child's anterior side, and the back side is configured to cover the child's posterior side. The garment further comprises a longitudinal zipper attached to the sleep sack, the longitudinal zipper extending along the bottom portion of the front side and the bottom portion of the back side; and one or more first fastener portions attached to the sleep sack. The kit further comprises a blanket having one or more blanket fastener portions attached thereto, the one or more blanket fastener portions configured to releasably engage the one or more first fastener portions to form one or more respective clothing fasteners that releasably attach the blanket to the sleep sack.

In one or more embodiments, the one or more fastener portions is/are one or more front fastener portions that are attached to the front side of the sleep sack, the one or more front fastener portions is/are configured to releasably engage one or more respective first blanket fastener portions on a first blanket to form one or more respective first clothing fasteners that releasably attach the first blanket to the front side of the sleep sack, and the garment further comprises one or more back fastener portions that is/are attached to the back side of the sleep sack, the one or more back fastener portions configured to releasably engage one or more respective second blanket fastener portions on a second blanket to form one or more respective second clothing fasteners that releasably attach the second blanket to the back side of the sleep sack.

BRIEF DESCRIPTION OF THE DRAWINGS

For a fuller understanding of the nature and advantages of the concepts disclosed herein, reference is made to the detailed description of preferred embodiments and the accompanying drawings.

DETAILED DESCRIPTION

A sleep sack is configured for use with a child safety car seat. The sleep sack includes a front side, a back side, an upper portion, and a lower portion. The lower portion includes a pair of leg sacks that fully enclose the child's respective legs. A longitudinal zipper is attached to upper portion of the front side, the bottom portion of the front side, and the bottom portion of the back side of the sleep sack. When the portion of the longitudinal zipper that extends along the bottom portion of the front and back sides is opened, the child's legs can separate and the crotch buckle in the child safety car seat can be accessed while the child's legs remain covered by the leg sacks.

A sleeping child wearing the sleep sack can be secured to or removed from the child safety car seat without disturbing the child.

The sleep sack can include fastener portions that allow a blanket with respective blanket fastener portions to be releasably attached to the sleep sack.

Figure 1:
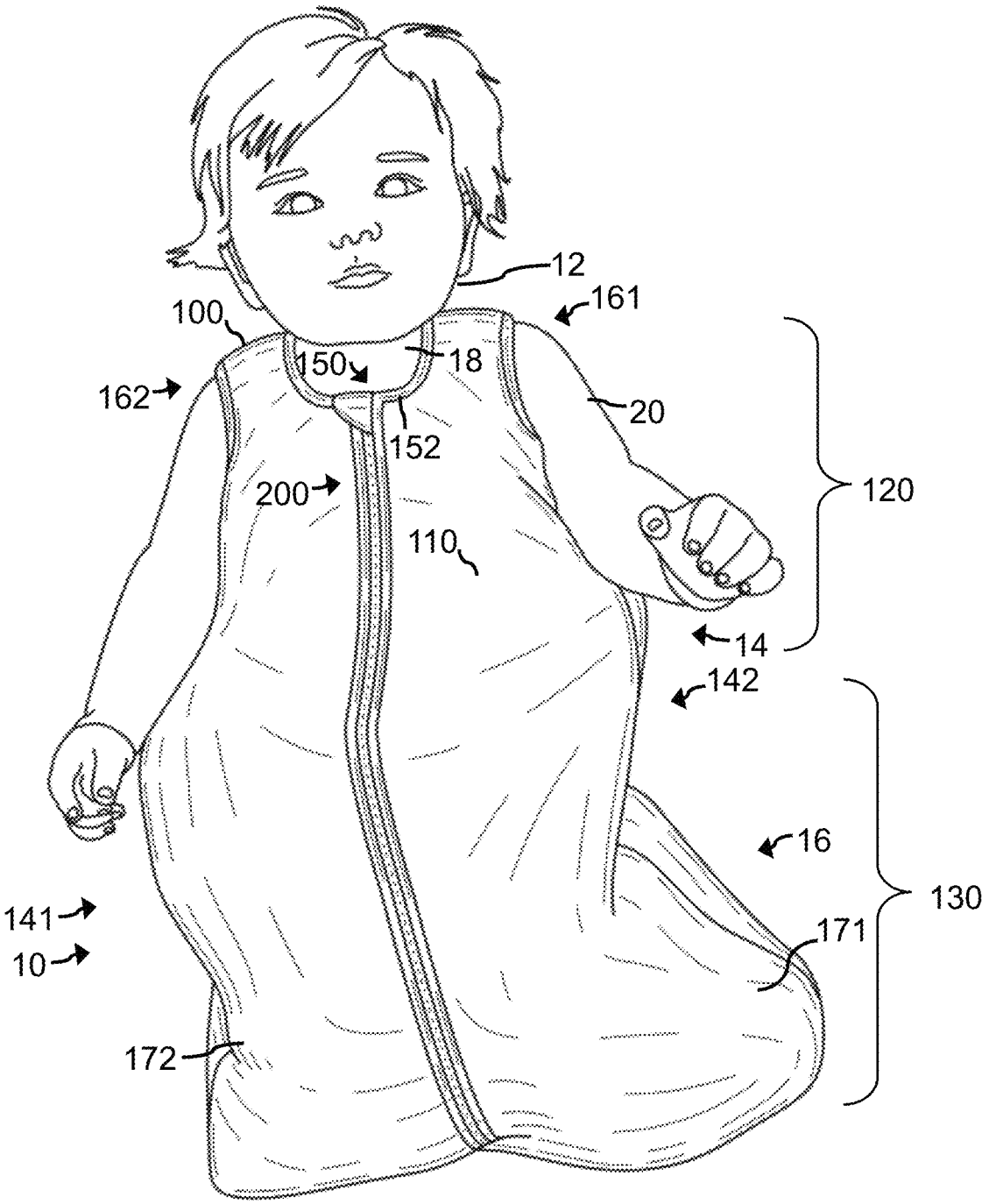
FIG. 1 is a perspective view of a garment worn by a child according to an embodiment.

FIG. 1 is a perspective view of a garment 10 worn by a child 12 according to an embodiment. The garment 10 includes a sleep sack 100 and a longitudinal zipper 200 attached to the sleep sack 100.

The sleep sack 100 can be formed of fabric such as cotton, polyester, linen, fleece, rayon, and/or other fabric(s). The fabric of the sleep sack 100 can be a natural fabric, a synthetic fabric, and/or a synthetic blend. The sleep sack 100 includes a body 110 that defines and/or is formed into various features as described herein. The sleep sack 100 has an upper portion 120 and a lower portion 130. The upper portion 120 is configured and/or sized to cover the torso 14 (e.g., the pelvis, the abdomen, the chest, and the back) of the child 12. The lower portion 130 is configured and/or sized to cover the legs 16 of the child 12. The sleep sack 100 further includes a front side 141 and a back side 142. The front side 141 is configured to cover the anterior side of the child 12 (e.g., the front of the torso 14 and the front of the legs 16). The back side 142 is configured to cover the posterior side of the child 12 (e.g., the back of the torso 14 and the back of the legs 16).

The upper portion 120 includes or defines a neck opening 150 and first and second arm openings 161, 162. The neck opening 150 is configured and/or sized to receive and/or surround the neck 18 of the child 12. A collar 152 can be attached around the neck opening 150. The first and second arm openings 161, 162 are configured and/or sized to receive and/or surround the arms 20 of the child 12. In the embodiment illustrated in FIG. 1, the first and second arm openings 161, 162 are located at the shoulders of the child 12 such that the upper portion 120 forms or resembles a vest. In other embodiments, the first and second arm openings 161, 162 can be located outwardly from the body 110 such that the upper portion 120 forms or resembles a short-sleeved garment (e.g., that partially covers the arms 20) or a long-sleeved garment (e.g., that fully or substantially covers the arms 20).

The lower portion 130 includes first and second leg sacks 171, 172 that are configured to receive and fully enclose the respective legs 16 of the child 12. For example, the first (or left) leg sack 171 is configured to receive and fully enclose the left leg of the child 12. Similarly, the second (or right) leg sack 172 is configured to receive and fully enclose the right leg of the child 12. When the longitudinal zipper 200 is in a closed configuration (e.g., the longitudinal zipper 200 is fully closed), as illustrated in FIG. 1, the first and second leg sacks 171, 172 are joined and/or attached to one another via the longitudinal zipper 200 such that the lower portion 130 mimics the appearance of a sleeping bag or a conventional sleep sack.

Figure 2:
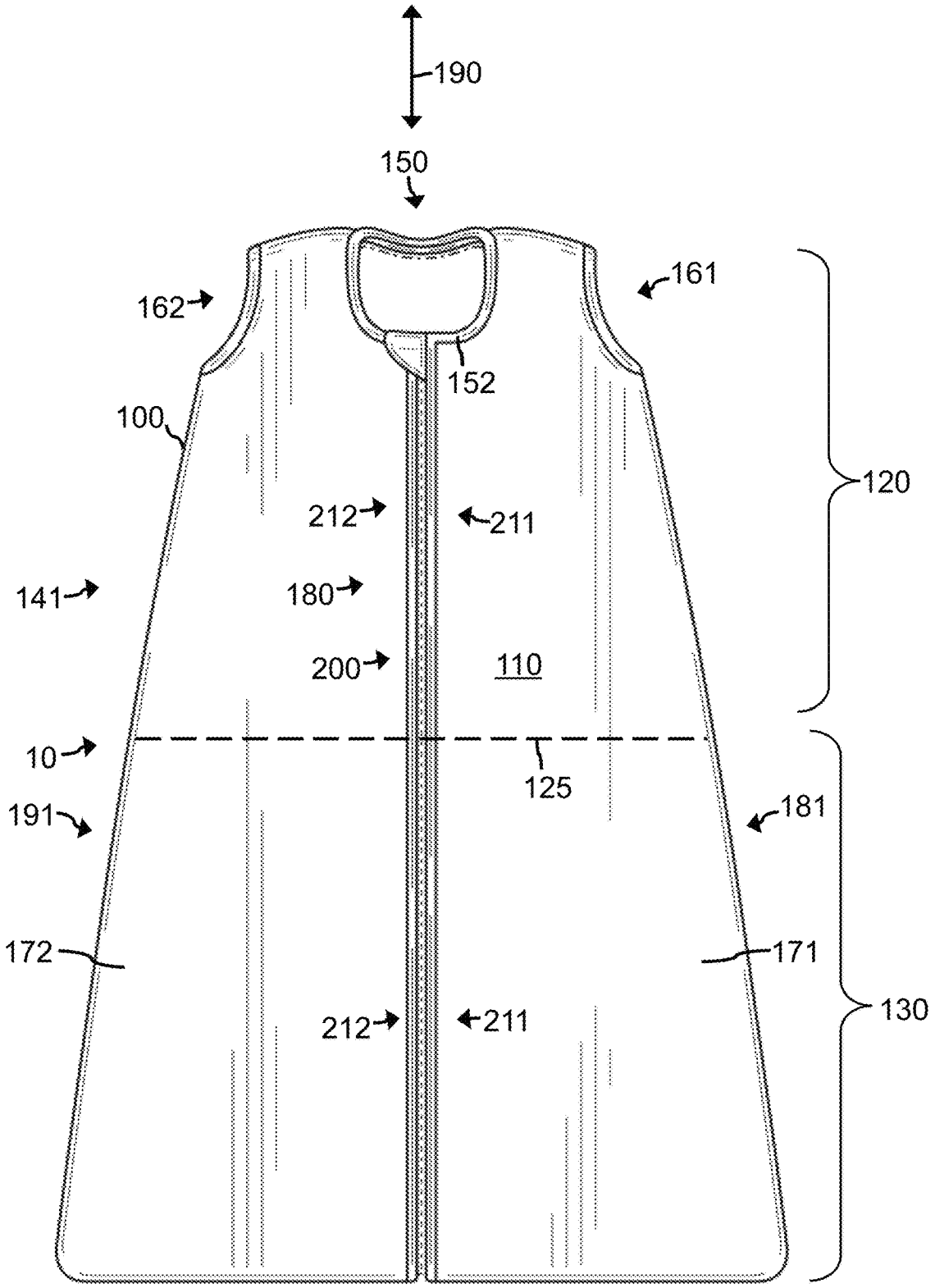
FIGS. 2 and 3 are front and back views, respectively, of the garment illustrated in FIG. 1 where the garment is in a fully closed configuration.
Figure 3:
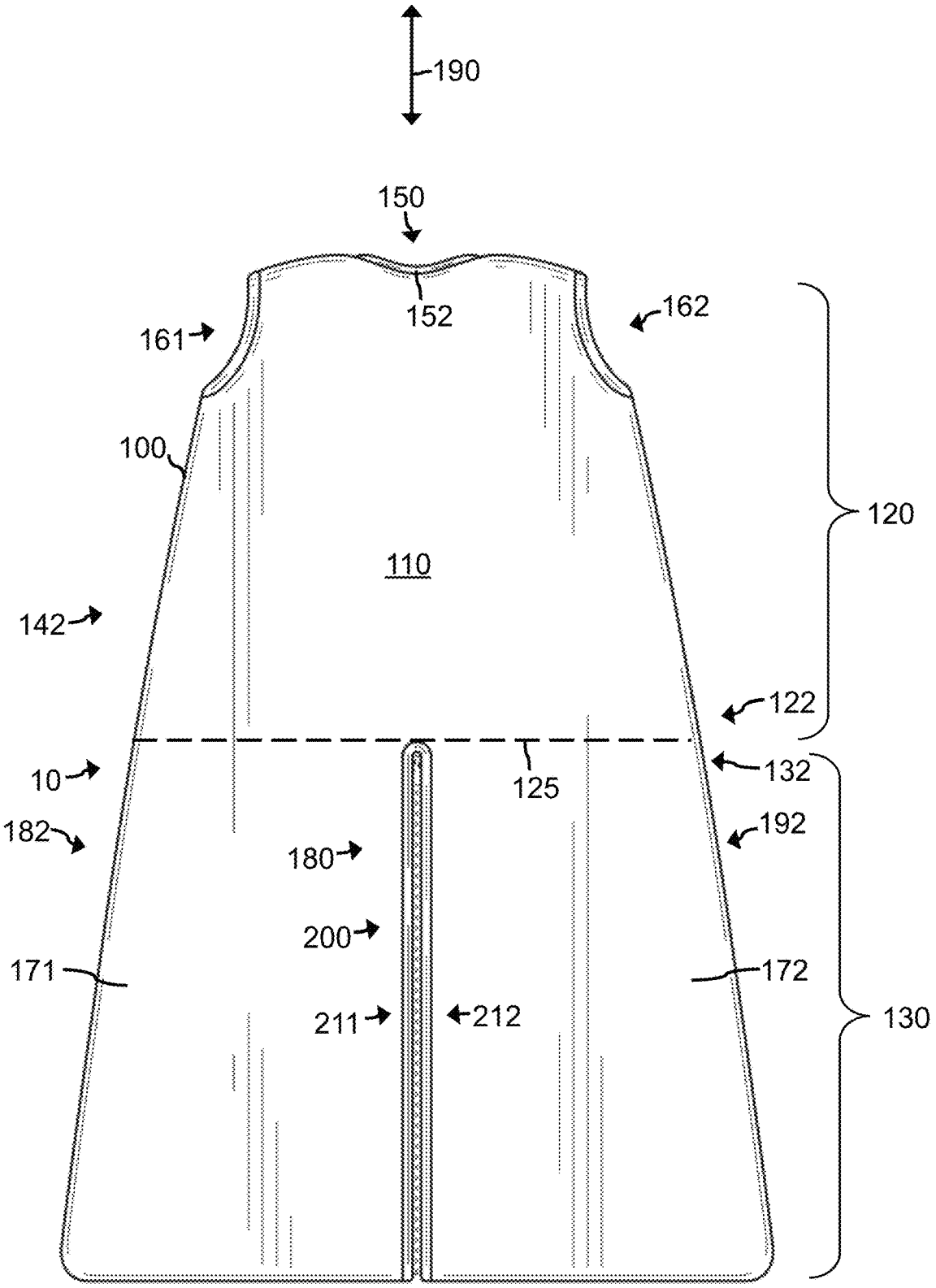

FIGS. 2 and 3 are front and back views, respectively, of the garment 10 in a fully closed configuration according to an embodiment. The garment 10 is illustrated in a closed configuration where the longitudinal zipper 200 is fully closed.

On the front side 141 (FIG. 2) of the sleep sack 100, the longitudinal zipper 200 extends along the upper portion 120 and the lower portion 130 of the sleep sack 100. For example, the longitudinal zipper 200 can extend (e.g., vertically extend) from or just below the collar 152 on the front side 141 of the sleep sack 100 to the bottom of the lower portion 130 on the front side 141 of the sleep sack 100. Thus, the longitudinal zipper 200 extends (e.g., vertically extends) across the upper and lower portions 120, 130 on the front side 141 of the sleep sack 100. The longitudinal zipper 200 continues from the front side 141 (FIG. 2) to the back side 142 (FIG. 3) (or vice versa) of the sleep sack 100.

On the back side 142 of the sleep sack 100, the longitudinal zipper 200 extends (e.g., vertically extends) across the lower portion 130 and terminates at approximately (e.g., with 1-3 inches) the interface 125 of the upper and lower portions 120, 130. As such, on the back side 142 the longitudinal zipper 200 can terminate at the top 132 of the lower portion 130, at the bottom 122 of the upper portion 120, or at the interface 125 of the upper and lower portions 120, 130. The interface 125 is configured to cover and/or align with the waist of the child.

Figure 8:
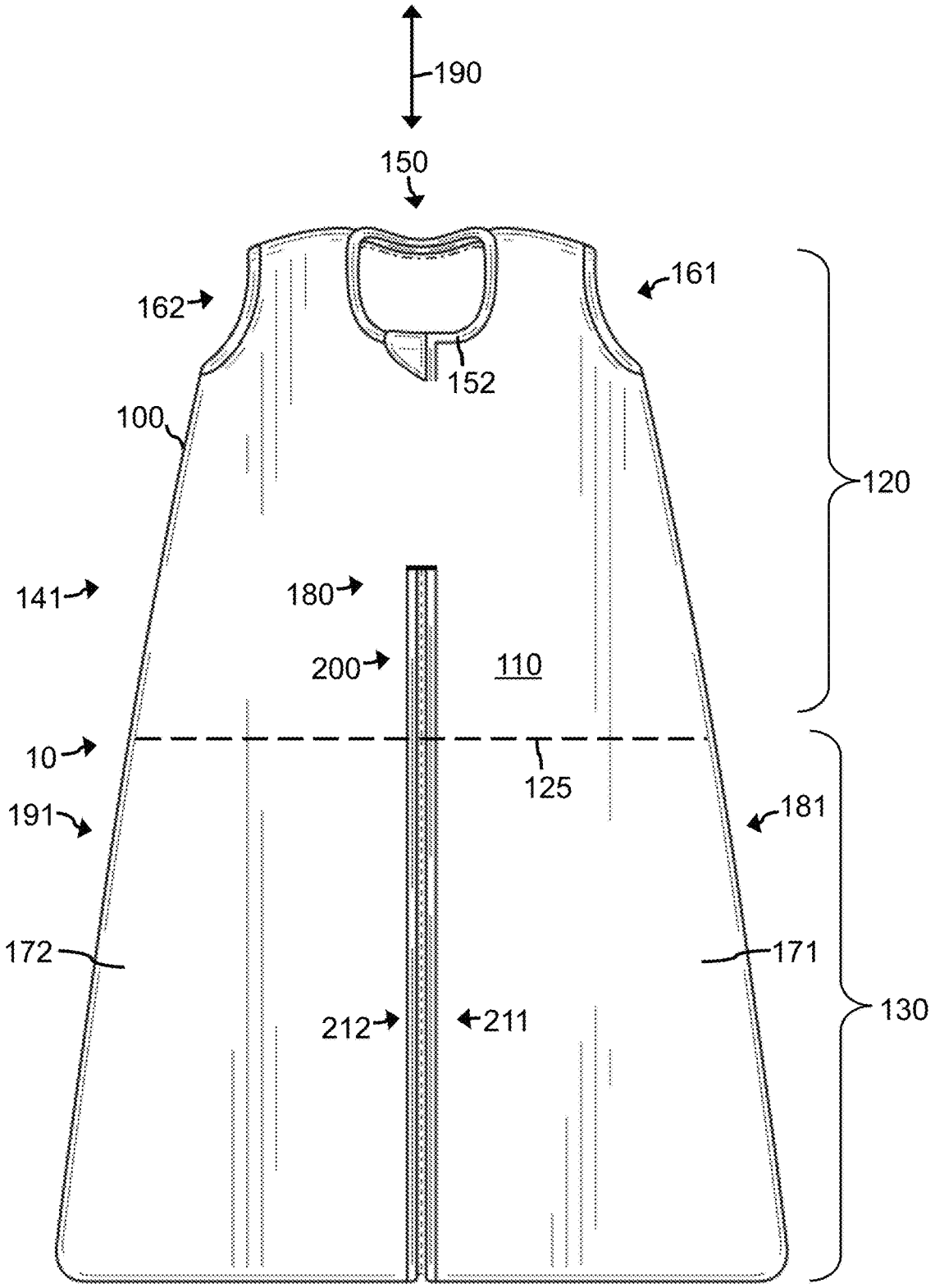
FIG. 8 is a front view of a garment according to another embodiment.

In an alternative embodiment, the longitudinal zipper 200 extends into only a portion of the upper portion 120, for example as illustrated in FIG. 8. For example, the longitudinal zipper 200 can extend only halfway into the upper portion 120. The longitudinal zipper 200 can terminate at a location in the upper portion 120 that corresponds with and/or is aligned with the child's stomach or chest.

Figure 9:
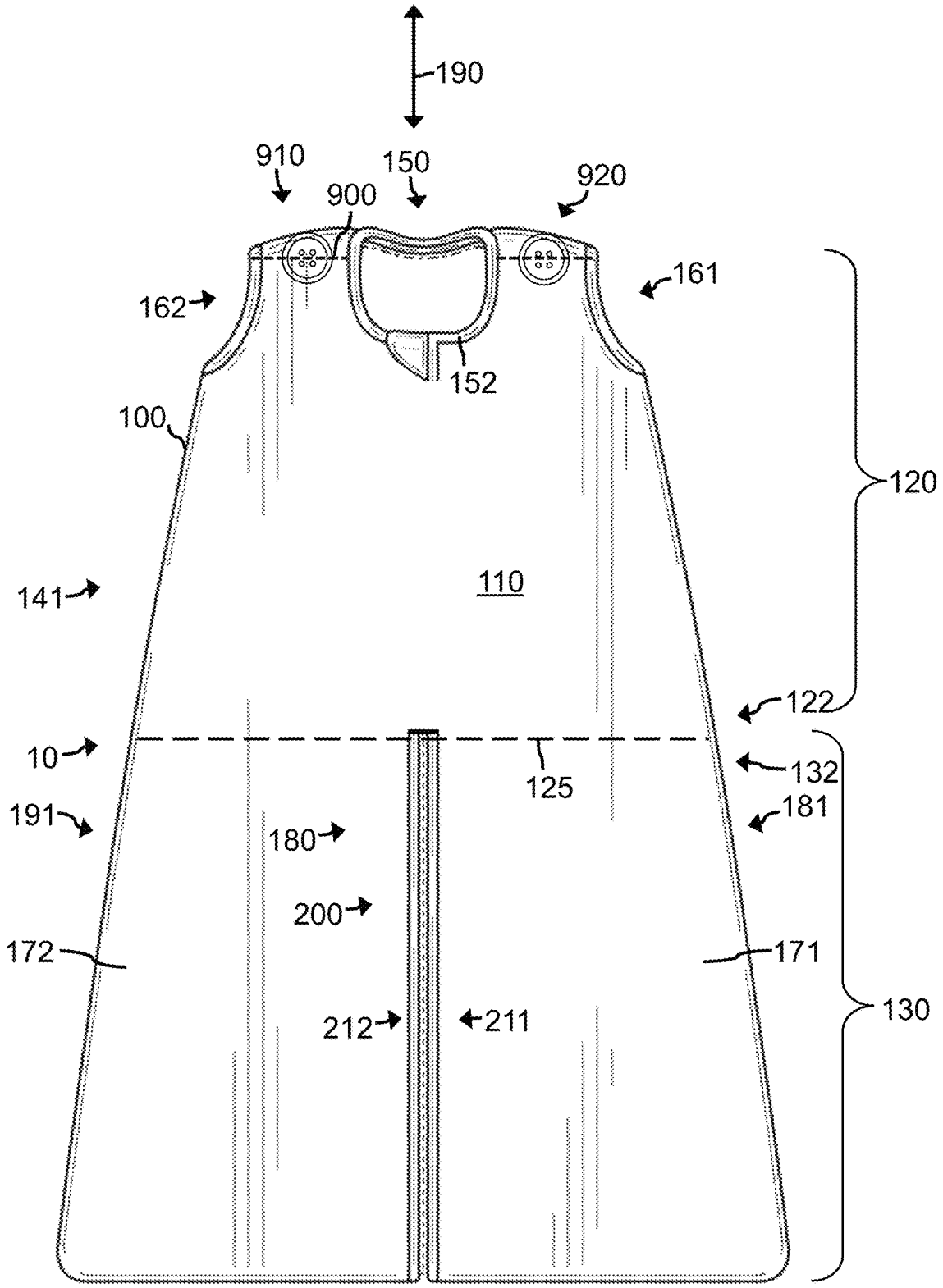
FIG. 9 is a front view of a garment according to another embodiment.

In another embodiment, the longitudinal zipper 200 can terminate at approximately (e.g., with 1-3 inches) the interface 125 of the upper and lower portions 120, 130, for example as illustrated in FIG. 9. As such, on the front side 141 the longitudinal zipper 200 can terminate at the top 132 of the lower portion 130, at the bottom 122 of the upper portion 120, or at the interface 125 of the upper and lower portions 120, 130. The upper portion 120 can include openings 900 at the shoulder 910 to allow the child to put on and take off the sleep sack through the top of the upper portion 120. The openings 900 can be closed with fasteners such as zippers or buttons 920.

Returning to FIGS. 2 and 3, the longitudinal zipper 200 can be attached along the center 180 of the front and back sides 141, 142 of the sleep sack 100. The center 180 of the sleep sack 100 can be defined by, aligned with, and/or collinear with a vertical axis of symmetry 190 of the front and back sides 141, 142 of the sleep sack 100. The longitudinal zipper 200 is preferably attached to the lower portion 130 of the front and back sides 141, 142 along or parallel to the vertical axis of symmetry 190 so that the longitudinal zipper 200 is located between the first and second leg sacks 171, 172. On the upper portion 120 of the front side 142, the longitudinal zipper 200 can extend diagonally, along, or parallel to the vertical axis of symmetry 190, or in another direction/orientation.

The longitudinal zipper 200 includes first and second sets of teeth 211, 212 that are configured to interlock when the longitudinal zipper 200 is closed and to separate when the longitudinal zipper 200 is opened. On the front side 141, the first set of teeth 211 is attached to the upper portion 120 and to the front side 181 of the first leg sack 171. On the back side 142, the first set of teeth 211 is attached to the back side 182 of the first leg sack 171. On the front side 141, the second set of teeth 212 is attached to the upper portion 120 and to the front side 191 of the second leg sack 172. On the back side 142, the second set of teeth 212 is attached to the back side 192 of the second leg sack 172.

Figure 4:
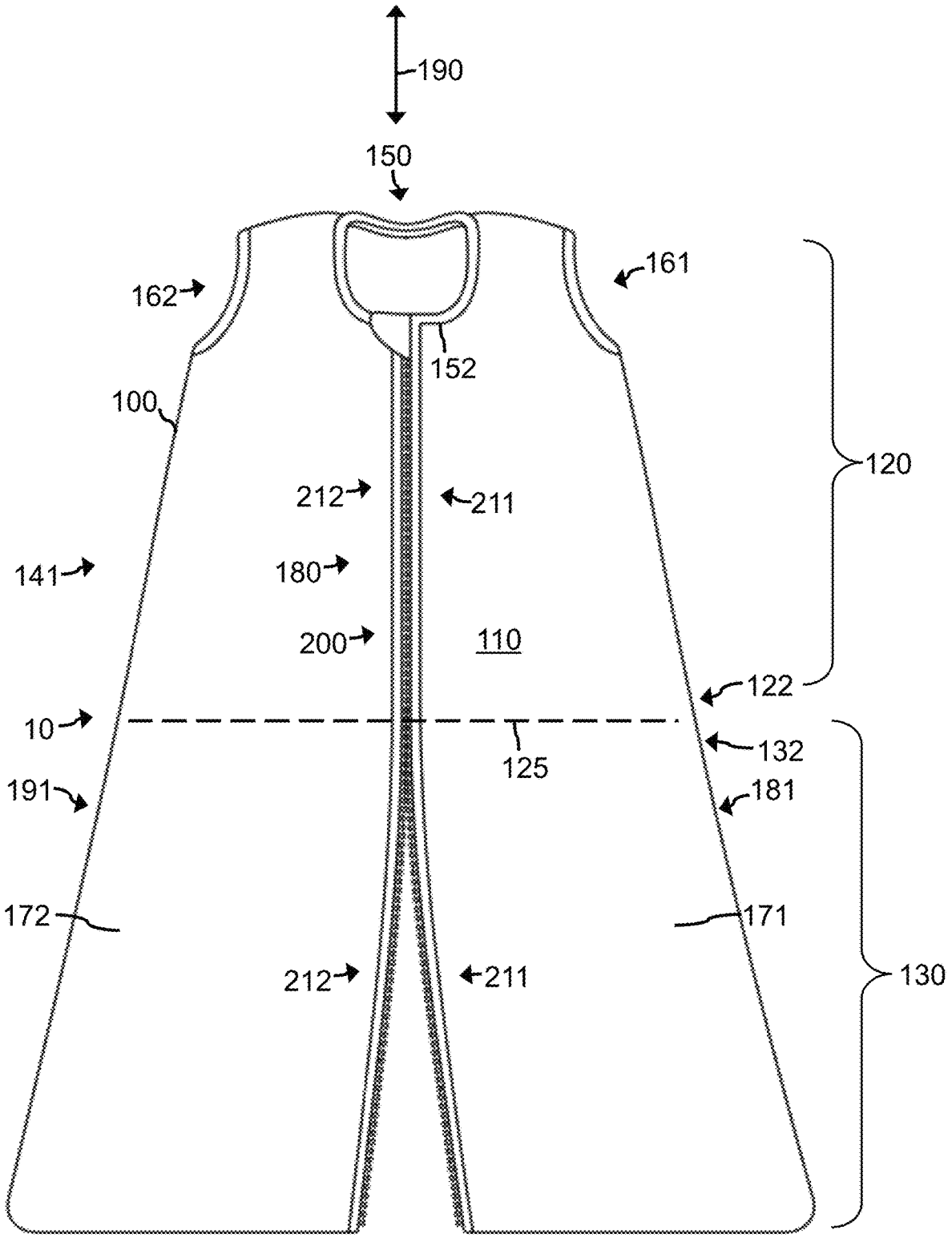
FIGS. 4 and 5 are front and back views, respectively, of the garment illustrated in FIG. 1 where the garment is in a car-seat configuration.
Figure 5:
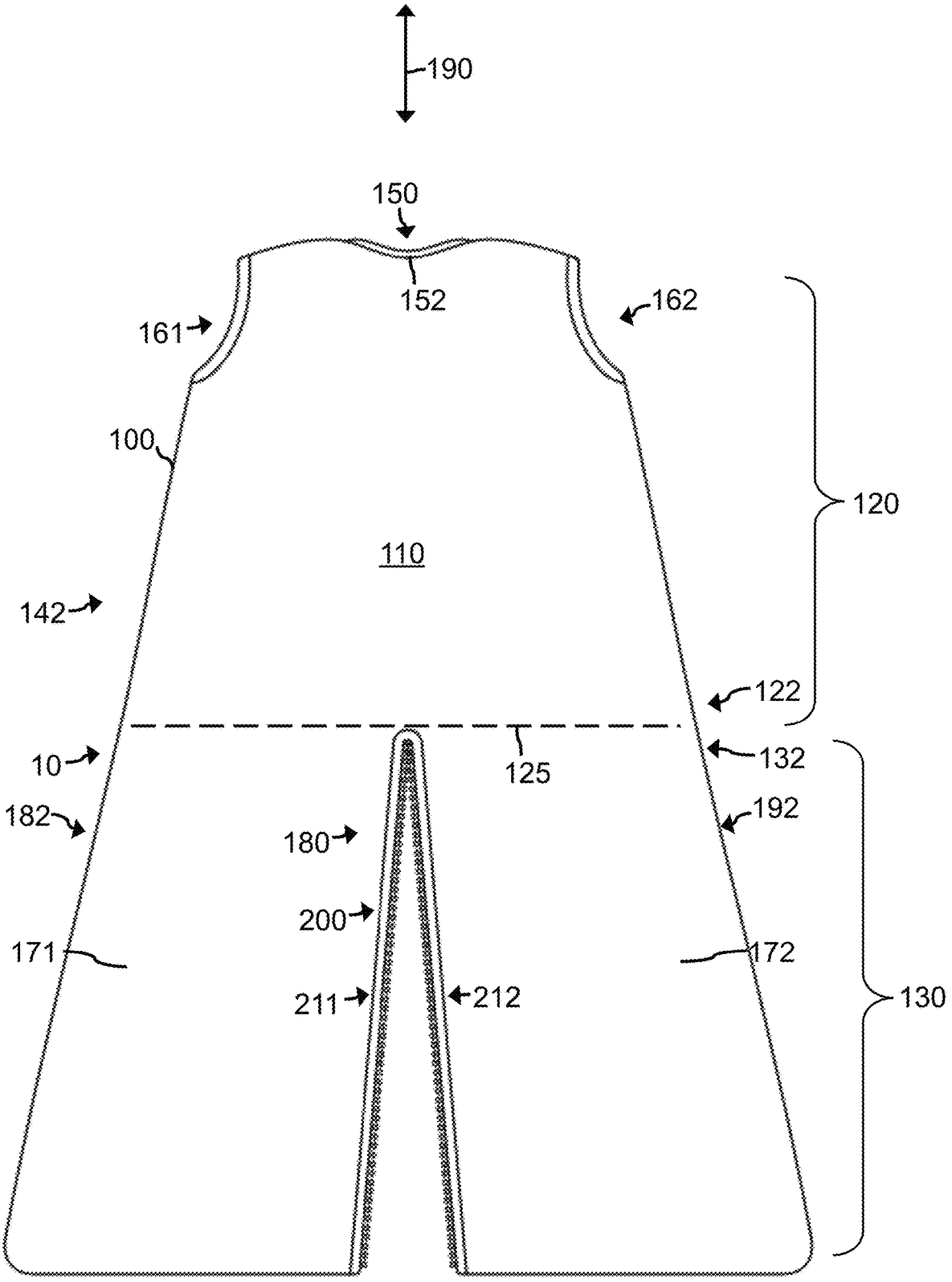

FIGS. 4 and 5 are front and back views, respectively, of the garment 10 in a car-seat configuration according to an embodiment. The garment 10 is illustrated in a car-seat configuration where the longitudinal zipper 200 is opened on the lower portion 130 of the front and back sides 141, 142. The longitudinal zipper 200 can be opened to the top 132 of the upper and/or lower portions 120, 130, to the bottom 122 of the upper and/or lower portions 120, 130, or to the interface 125 of the upper and lower portions 120, 130.

In the car-seat configuration, the opened longitudinal zipper 200 in the lower portion 130 of the front and back sides 141, 142 allows the child's legs in the first and second leg sacks 171, 172 to separate and provides access to a groin buckle in a car seat (e.g., a car seat having a five-point harness) without having to feed the groin buckle through the garment 10. Since the child's legs are in the first and second leg sacks 171, 172, the child's legs remain covered regardless of the position and/or closure state of the longitudinal zipper 200.

Figure 6:
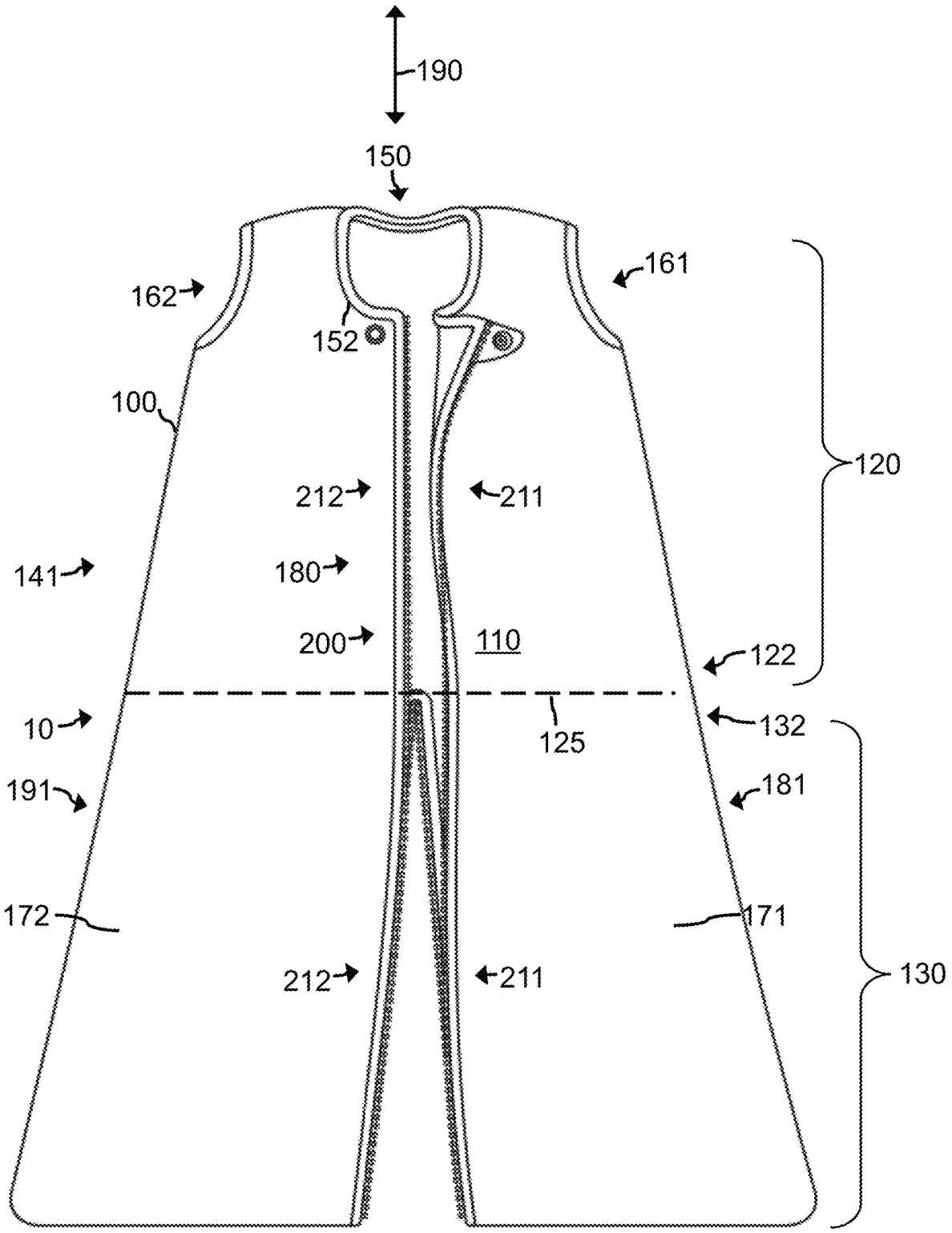
FIG. 6 is a front view of the garment illustrated in FIG. 1 where the garment is in an opened configuration.

FIG. 6 is a front view of the garment 10 in an opened configuration in which the longitudinal zipper 200 is fully opened. The opened configuration can be used to remove the child from the garment 10 or to place the child into the garment 10. The back view of the garment 10 in the opened configuration appears the same as the garment 10 illustrated in FIG. 5.

Figure 7:
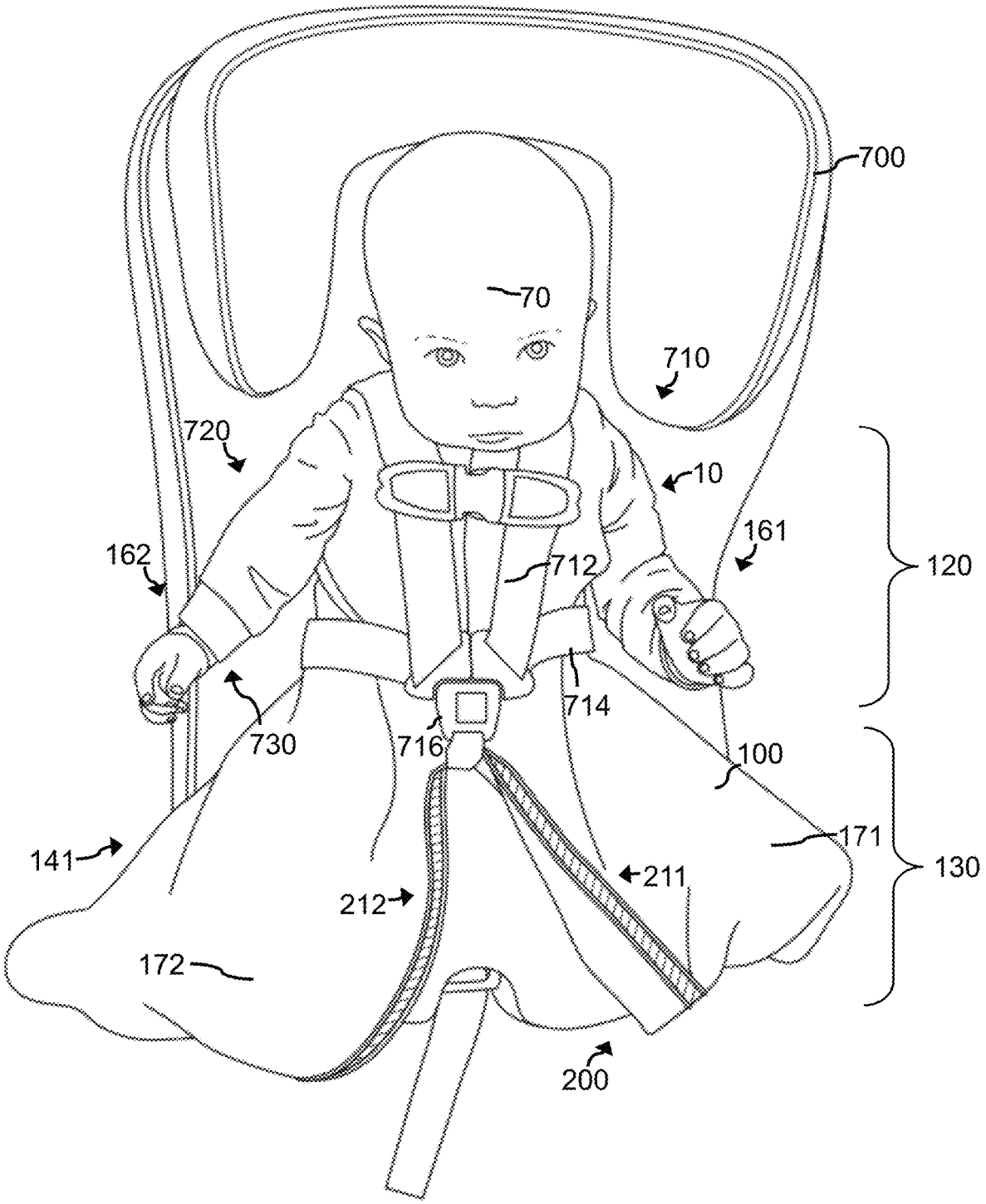
FIG. 7 is a perspective view of the garment worn by a child that is secured to a child safety car seat.

FIG. 7 is a perspective view of the garment 10 worn by a child 70 secured to a child safety car seat 700 according to an embodiment. The child safety car seat 700 includes a five-point harness 710 in which two shoulder straps 712 and two waist straps 714 are releasably secured to a groin buckle 716 between the child's legs.

In this embodiment, the garment 10 has long sleeves 720 where the first and second arm openings 161, 162 are approximately aligned with (e.g., within about an inch of) the child's wrists 730.

The garment 10 is illustrated in the car-seat configuration where the groin buckle 716 is exposed. The groin buckle 716 does not pass through the garment 10. The opened longitudinal zipper 200 in the lower portion 130 of the front and back sides 141, 142 of the garment 10 allows the buckles of the shoulder and waist straps 712, 714 to be secured to or removed from the groin buckle 716. Thus, a sleeping child wearing the garment 10 can continue to wear the garment 10 when being placed into or removed from the child safety car seat 700.

Figure 10:
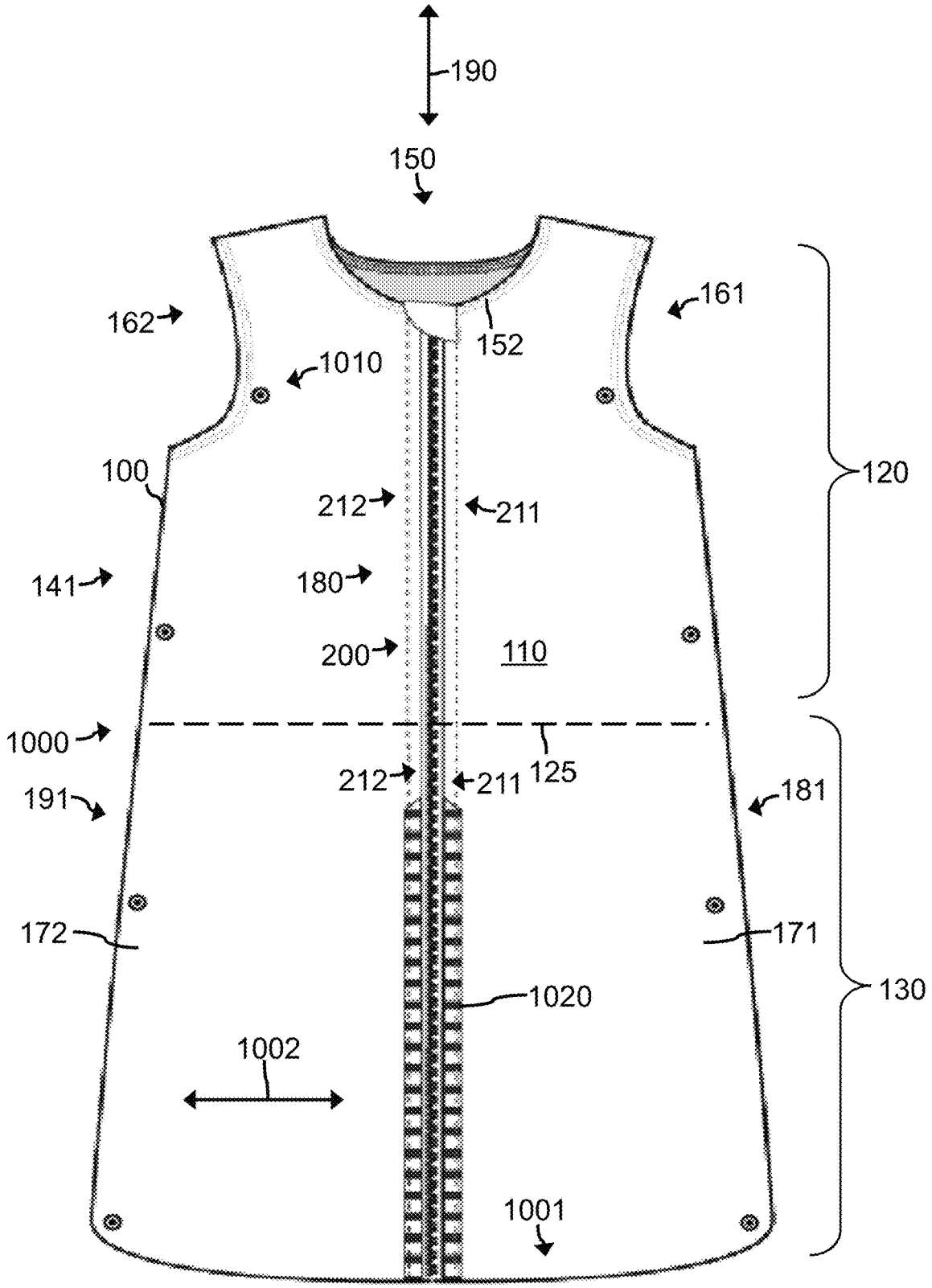
FIG. 10 is a front view of a garment in a fully closed configuration according to another embodiment.

FIG. 10 is a front view of a garment 1000 in a fully closed configuration according to an embodiment. The garment 1000 is the same as the garment 10 except that the garment 1000 includes one or more optional front fastener portions 1010 attached to the front side 141 of the garment 1000. The one or more front fastener portions 1010 can include or can consist of one or more zippers (e.g., one or more sets of teeth for one or more respective zippers), one or more hook-and-loop fasteners (e.g., Velcro) (e.g., one or more sets of hooks for one or more respective sets of hook-and-loop fasteners and/or one or more sets of loops for one or more respective sets of hook-and-loop fasteners), one or more buttons (or one or more slits and/or loops to receive one or more buttons), one or more magnetic fasteners (e.g., one or more magnets for one or more respective sets of magnetic fasteners), and/or one or more snap fasteners (e.g., one or more studs for one or more respective sets of snap fasteners and/or one or more sockets for one or more respective sets of snap fasteners).

The front fastener portion(s) 1010 is/are configured to engage with one or more respective blanket fastener portions that is/are attached to a blanket to form one or more respective clothing fasteners that can releasably attach the blanket to the garment 1000. The clothing fasteners can include or consist of one or more zippers, one or more sets of hook-and-loop fasteners, one or more sets of button fasteners, one or more sets of magnetic fasteners, and/or one or more sets of snap fasteners.

In FIG. 10, the front fastener portion(s) 1010 comprise a plurality of studs for a respective plurality of respective sets of snap fasteners. The front fastener portion(s) 1010 are symmetrically arranged on the front side 141 of the garment 1000 with respect to the vertical axis of symmetry 190 and are placed along the sides of the front side 141 of the garment 1000. In other embodiments, the front fastener portion(s) 1010 can be asymmetrically arranged on the front side 141 of the garment 1000 with respect to the vertical axis of symmetry 190 and/or are placed on different portions of the front side 141 of the garment 1000.

The garment 1000 also includes an optional indicator strip 1020 that extends along at least a portion of the longitudinal zipper 200. The indicator strip 1020 can provide a visual indication to a caregiver that the garment 1000 is compatible and safe to use with a car seat.

Figure 11:
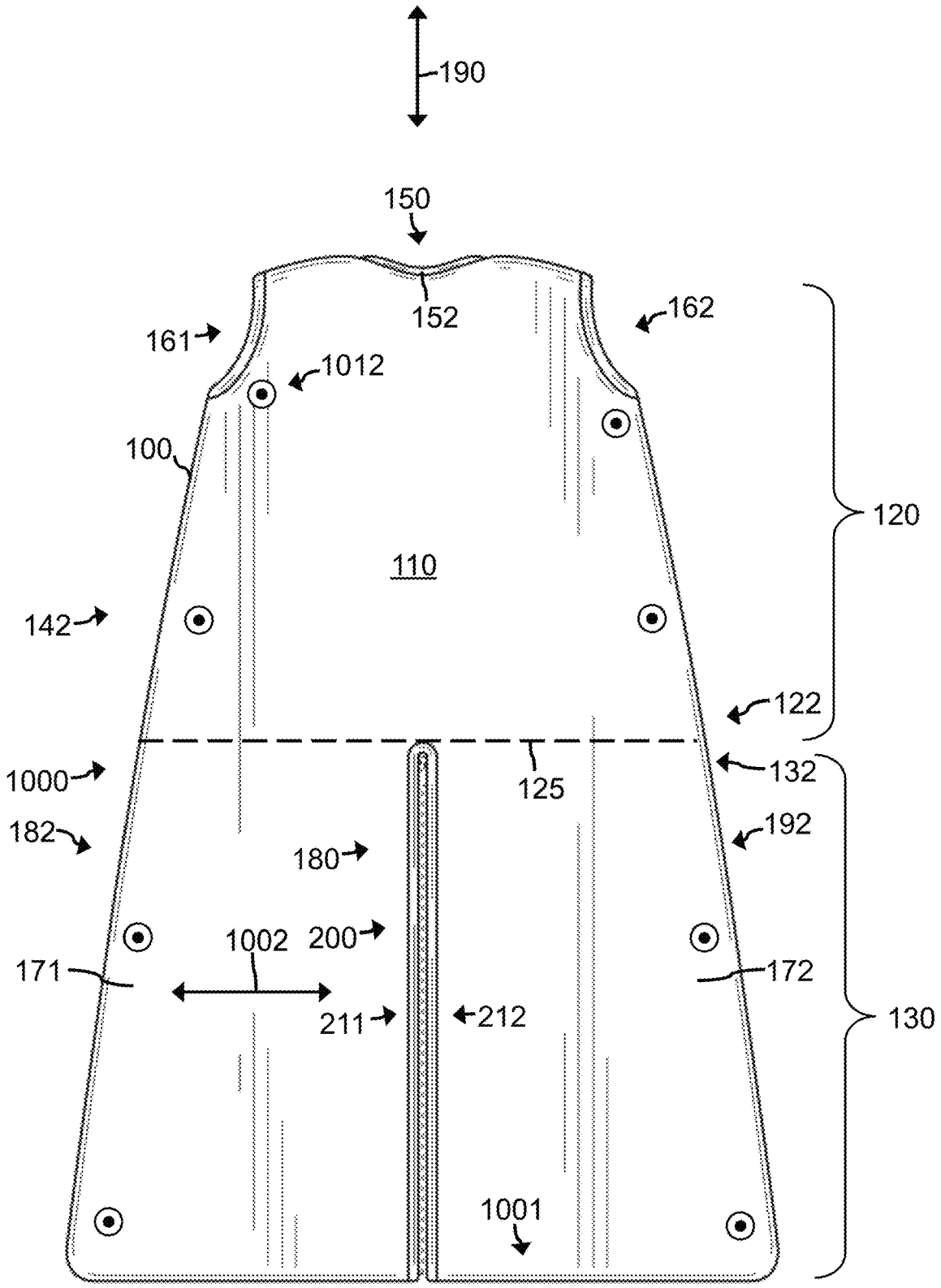
FIG. 11 is a back view of the garment illustrated in FIG. 10.

FIG. 11 is a back view of the garment 1000 in a fully closed configuration according to an embodiment. The garment 1000 includes one or more optional back fastener portions 1012 attached to the back side 142 of the garment 1000. The back fastener portion(s) 1012 can be the same as or different than the front fastener portion(s) 1010. In FIG. 11, the back fastener portion(s) 1012 comprise a plurality of studs for a respective plurality of respective sets of snap fasteners. The back fastener portion(s) 1012 are symmetrically arranged on the back side 142 of the garment 1000 with respect to the vertical axis of symmetry 190 and are placed along the sides of the back side 142 of the garment 1000. In other embodiments, the back fastener portion(s) 1012 can be asymmetrically arranged on the back side 142 of the garment 1000 with respect to the vertical axis of symmetry 190 and/or are placed on different portions of the back side 142 of the garment 1000.

The back fastener portion(s) 1010 is/are configured to engage with one or more respective blanket fastener portions that is/are attached to a blanket to form one or more respective clothing fasteners that can releasably attach the blanket to the garment 1000.

In some embodiments, the garment 1000 includes the front fastener portion(s) 1010 but does not include the back fastener portion(s) 1012. In other embodiments, the garment 1000 includes the back fastener portion(s) 1012 but does not include the front fastener portion(s) 1010. In yet other embodiments, the garment 1000 includes both the front fastener portion(s) 1010 and the back fastener portion(s) 1012.

When the garment 1000 includes the front fastener portion(s) 1010, a blanket can be attached to the front side 141 of the garment 1000. When the garment 1000 includes the back fastener portion(s) 1012, a blanket can be attached to the back side 142 of the garment 1000. When the garment 1000 includes the front fastener portion(s) 1010 and the back fastener portion(s) 1012, a first blanket can be attached to the front side 141 of the garment 1000 and a second blanket can be attached to the back side 142 of the garment 1000. Alternatively, when the garment 1000 includes the front fastener portion(s) 1010 and the back fastener portion(s) 1012, the same blanket (e.g., a first blanket) can be attached to either the front side 141 or the back side 142 of the garment 1000.

Figure 12:
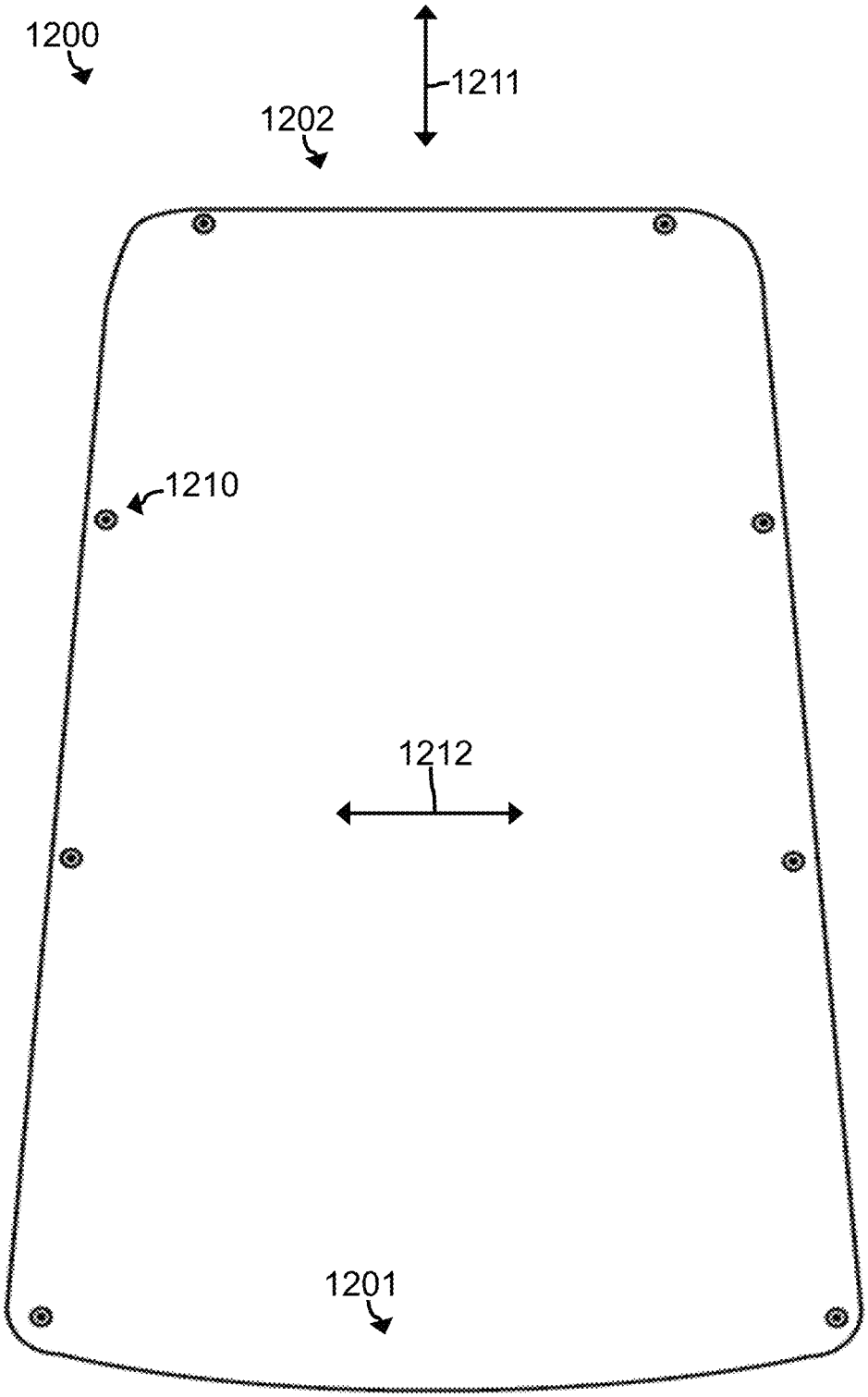
FIG. 12 is a back view of a blanket that is configured to be releasably attached to the garment illustrated in FIGS. 10 and 11.

FIG. 12 is a back view of a blanket 1200 that is configured to be releasably attached to the garment 1000, according to an embodiment. The garment 1000 includes one or more blanket fastener portions 1210 that is/are configured to releasably engage the front fastener portion(s) 1010 or the back fastener portion(s) 1012 of the garment 1000 to form one or more respective clothing fasteners. In FIG. 11, the blanket fastener portion(s) 1210 comprise a plurality of sockets that are configured to engage the respective sockets of the front fastener portion(s) 1010 or the back fastener portion(s) 1012 to form respective sets of snap fasteners.

The blanket fastener portion(s) 1210 is/are complementary to the front fastener portion(s) 1010 or the back fastener portion(s) 1012. For example, when the front fastener portion(s) 1010 or the back fastener portion(s) 1012 include one or more sets of teeth for one or more respective zippers, the blanket fastener portion(s) 1210 include one or more complementary sets of teeth to form the one or more respective zippers. Additionally or alternatively, when the front fastener portion(s) 1010 or the back fastener portion(s) 1012 include one or more sets of hooks (or one or more sets of loops) for one or more respective sets of hook-and-loop fasteners, the blanket fastener portion(s) 1210 include one or more complementary sets of loops (or one or more sets of hooks) to form the one or more respective sets of hook-and-loop fasteners. Additionally or alternatively, when the front fastener portion(s) 1010 or the back fastener portion(s) 1012 include one or more buttons (or one or more slits and/or loops to receive one or more buttons) for one or more respective sets of button fasteners, the blanket fastener portion(s) 1210 include one or more slits and/or loops (or one or more buttons) to form the one or more respective sets of button fasteners. Additionally or alternatively, when the front fastener portion(s) 1010 or the back fastener portion(s) 1012 include one or more magnetic fasteners (e.g., having a first polarity oriented in a first direction) for one or more respective sets of magnetic fasteners, the blanket fastener portion(s) 1210 include one or more magnetic fasteners (e.g., having a first polarity oriented in a first second direction that is opposite to the first direction) to form the one or more respective sets of magnetic fasteners. Additionally or alternatively, when the front fastener portion(s) 1010 or the back fastener portion(s) 1012 include one or more studs (or one or more sockets) for one or more respective sets of snap fasteners (e.g., as illustrated in FIGS. 10 and 11), the blanket fastener portion(s) 1210 include one or more sockets (or one or more studs) to form for the one or more respective sets of snap fasteners.

The blanket 1200 has a shape that generally conforms to the shape of the front side 141 and the back side 142 of the garment 1000. The blanket 1200 has a length that can be measured with respect to a first axis 1211 and a width that can be measured with respect to a second axis 1212 that is orthogonal to the first axis 1211. When the blanket 1200 is attached to the garment 1000 (e.g., to the front side 141 or the back side 142), the first axis 1211 is parallel to the axis of symmetry 190. The length of the blanket 1200 can be smaller than the length of the garment 1000, where the length of the garment is measured with respect to the axis of symmetry 190. The width of the blanket 1200 can be the same or approximately the same as (e.g., within about 10% of) the width of the garment 1000, where the width of the garment 1000 is measured with respect to a second axis 1002 (FIGS. 10, 11) that is orthogonal to the axis of symmetry 190. The width of the blanket 1200 can vary along the length of the blanket 1200. For example, the width of the blanket 1200 can taper from a bottom 1201 of the blanket 1200 to a top 1202 of the blanket 1200. The first axis 1211 can be an axis of symmetry of the blanket 1200.

In some embodiments, the blanket 1200 can include blanket fasteners portions 1210 on front and back sides of the blanket 1200 to allow the blanket to be releasably attached to other blankets to increase the warmth. For example, FIG. 12 can represent the front side of the blanket 1200 and the back side of the blanket 1200 can appear the same or similar to the front side of the blanket 1200.

Figure 13:
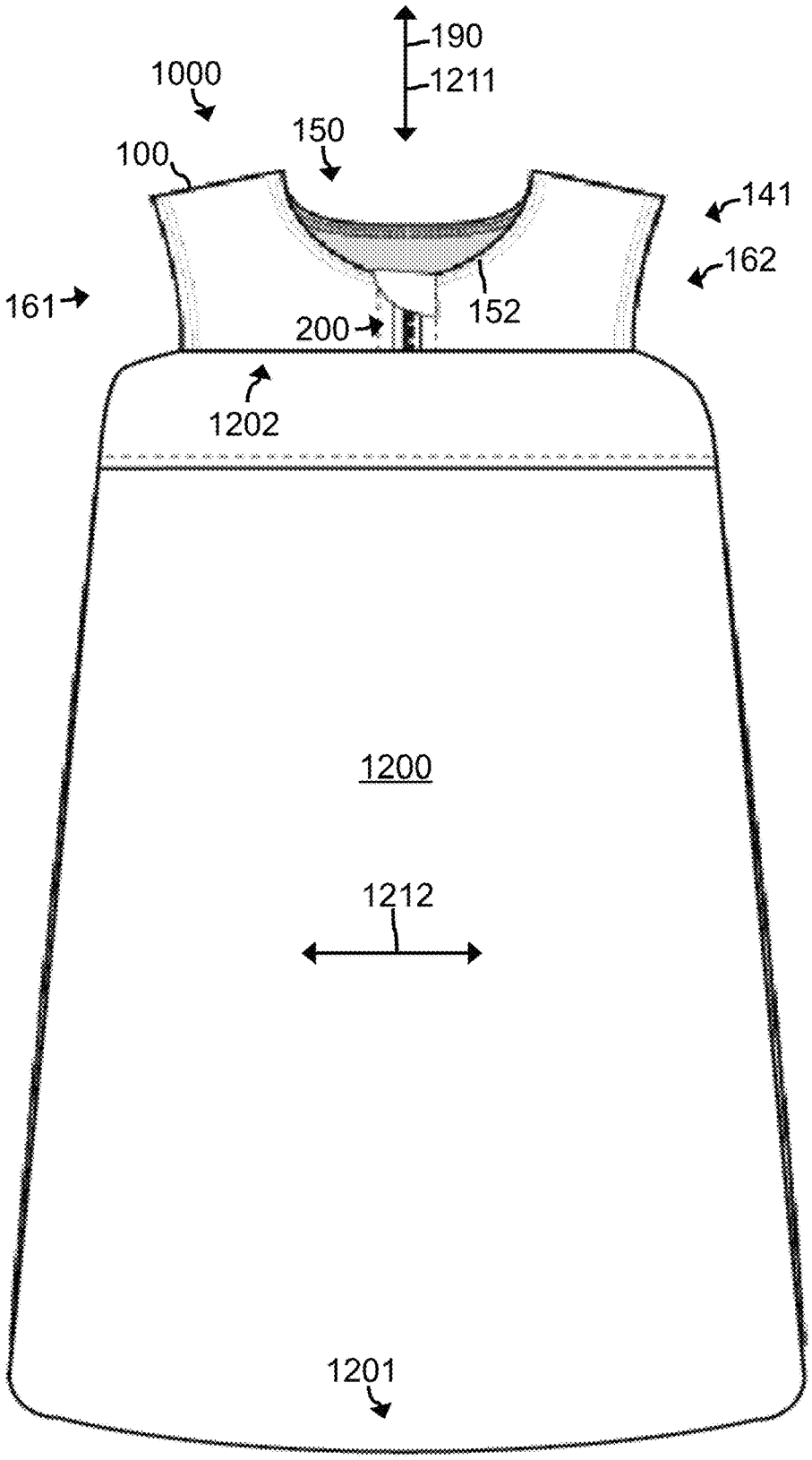
FIG. 13 illustrates a blanket attached to the front side of the garment illustrated in FIG. 10.

FIG. 13 illustrates the blanket 1200 attached to the front side 141 of the garment 1000 according to an embodiment. In the attached configuration, the top 1202 of the blanket 1200 can be aligned with or approximately aligned with (e.g., within about an inch of) the first and second arm openings 161, 162. The blanket 1200 can extend below the first and second arm openings 161, 162 to be out of the way of the child's arms. In addition, the blanket 1200 can extend below the collar 152 to be out of the way of the child's face.

The bottom 1201 of the blanket 1200 can be aligned with or approximately aligned with (e.g., within about an inch of) a bottom 1001 (FIGS. 10, 11) of the garment 1000, which corresponds to a location of the child's feet or a portion of the garment 1000 that extends beyond the child's feet depending on the size of the child.

The garment 1000 can be in the closed configuration or the car-seat configuration when the blanket 1200 is attached to the garment 1000. Some or all of the blanket 1200 can be detached from the garment 1000 to transition the garment 1000 between the closed configuration and the car-seat configuration. For example, the blanket fastener portions 1210 corresponding to the lower portion 130 of the garment 1000 can be detached from the respective front fastener portions 1010 to provide access to the longitudinal zipper 200 in the lower portion 130 to release or separate the first and second leg sacks 171, 172.

Figure 14:
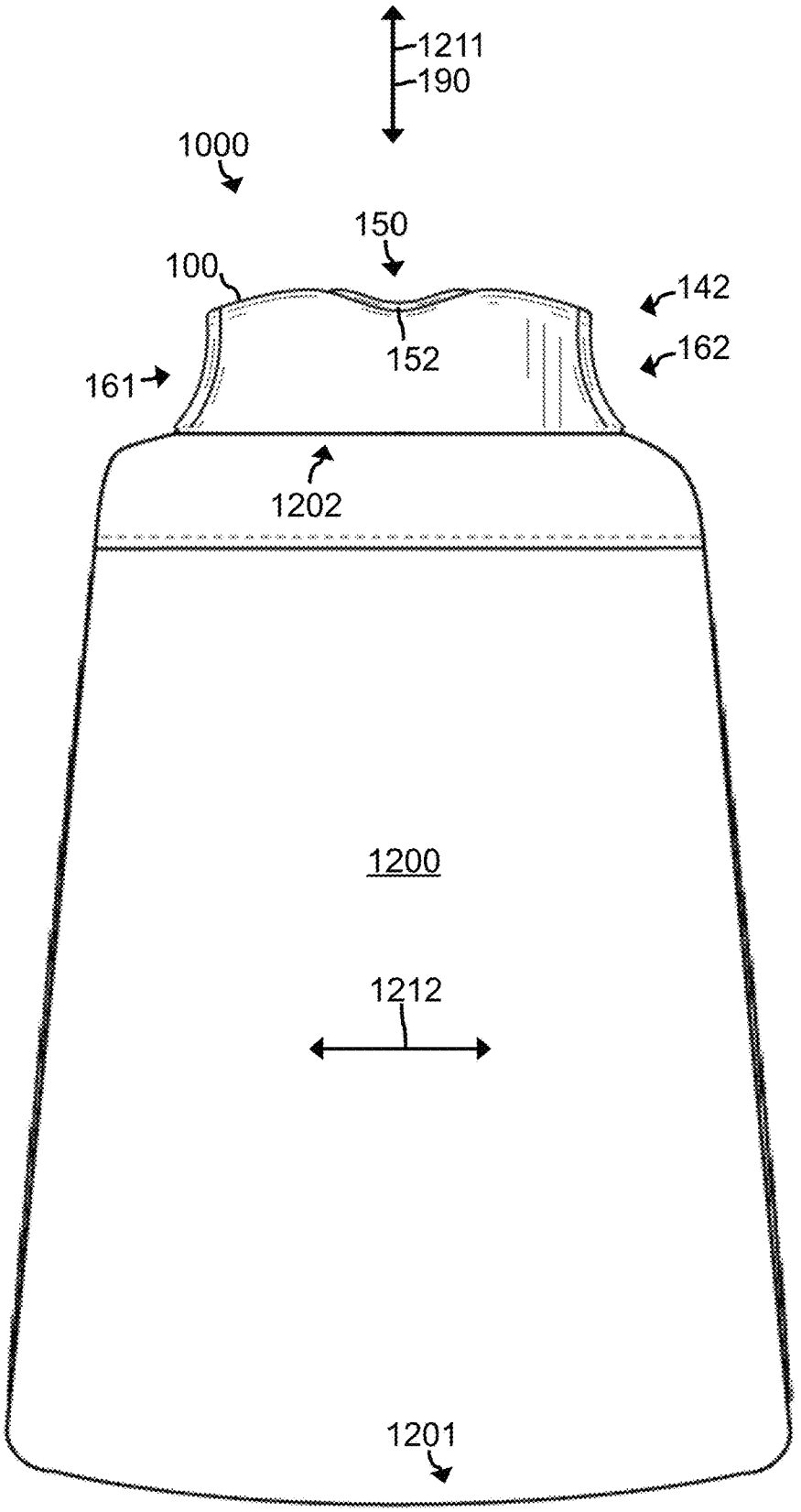
FIG. 14 illustrates a blanket attached to the back side of the garment illustrated in FIG. 11.

FIG. 14 illustrates the blanket 1200 attached to the back side 142 of the garment 1000 according to an embodiment. In the attached configuration, the top 1202 of the blanket 1200 can be aligned with or approximately aligned with (e.g., within about an inch of) the first and second arm openings 161, 162. The blanket 1200 can extend below the first and second arm openings 161, 162 to be out of the way of the child's arms. In addition, the blanket 1200 can extend below the collar 152 to be out of the way of the child's head.

The bottom 1201 of the blanket 1200 can be aligned with or approximately aligned with (e.g., within about an inch of) the bottom 1001 (FIGS. 10, 11) of the garment 1000.

The garment 1000 can be in the closed configuration or the car-seat configuration when the blanket 1200 is attached to the garment 1000. Some or all of the blanket 1200 can be detached from the garment 1000 to transition the garment 1000 between the closed configuration and the car-seat configuration. For example, the blanket fastener portions 1210 corresponding to the lower portion 130 of the garment 1000 can be detached from the respective front fastener portions 1010 to provide access to the longitudinal zipper 200 in the lower portion 130 to release or separate the first and second leg sacks 171, 172.

Thus, the garment 1000 can have a first configuration in which the blanket 1200 is attached to the front side 141 of the garment 1000 (e.g., as illustrated in FIG. 12) and a second configuration in which the blanket 1200 is attached to the back side 142 of the garment 1000. Alternatively, a first blanket 1200 can be attached to the front side 141 of the garment 1000 and a second blanket 1200 can be attached to the back side 142 of the garment 1000.

Figure 15:
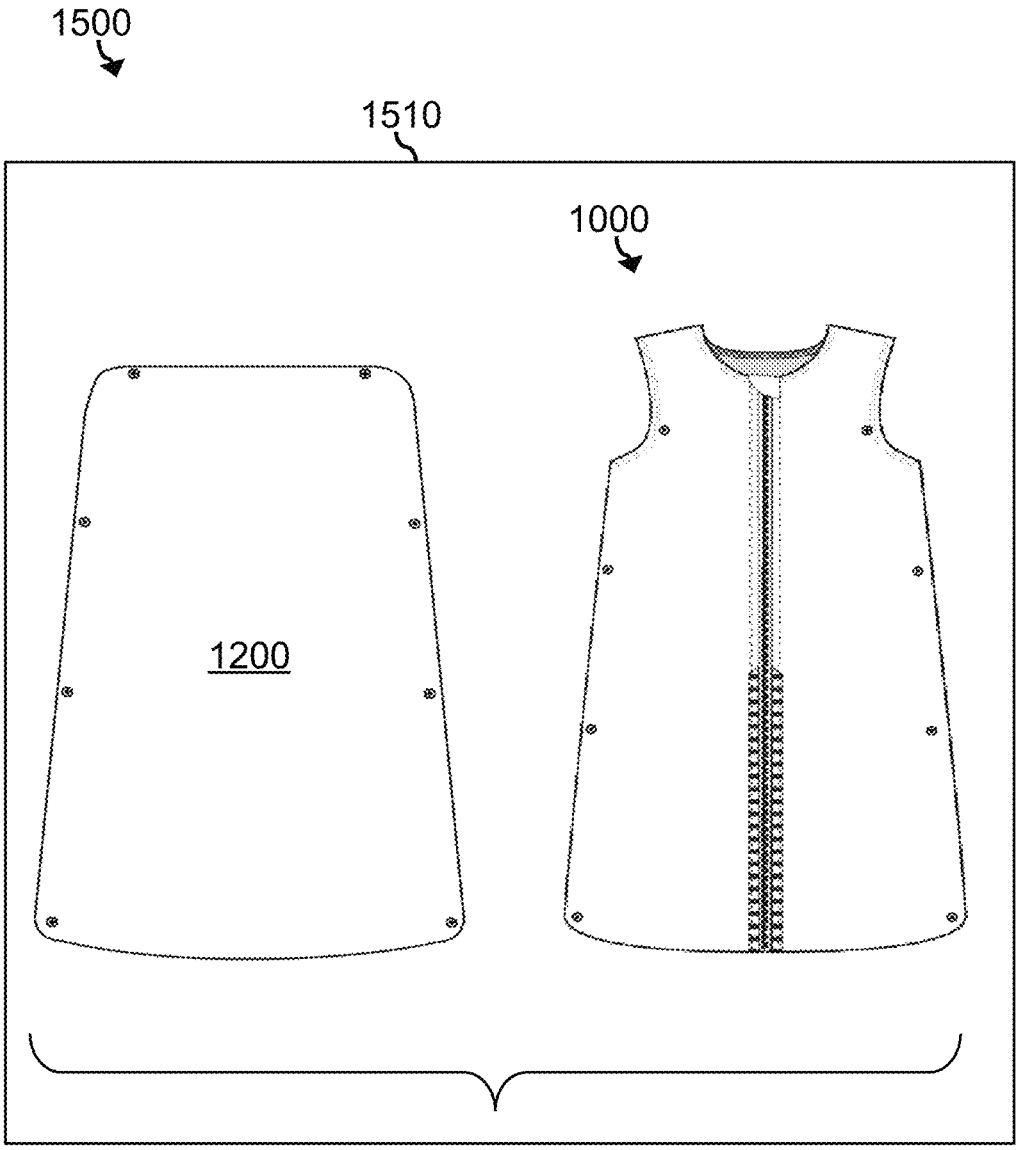
FIG. 15 illustrates a kit that includes a sleep sack and a blanket.

FIG. 15 illustrates a kit 1500 that includes the sleep sack 1000 and the blanket 1200. The kit 1500 can include common packaging 1510 to sell or transport the sleep sack 1000 and the blanket 1200 together.

The invention should not be considered limited to the particular embodiments described above, but rather should be understood to cover all aspects of the invention as fairly set out in the attached claims. Various modifications, equivalent processes, as well as numerous structures to which the invention may be applicable, will be apparent to those skilled in the art to which the invention is directed upon review of this disclosure. The claims are intended to cover such modifications and equivalents.

Also, as described, some aspects may be embodied as one or more methods. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

What is claimed is:

1. A garment configured for use with a child safety car seat, comprising:

a sleep sack having a front side, a back side, an upper portion, a lower portion, a neck opening, and first and second arm openings;

one or more first fastener portions attached to the sleep sack; and a blanket having one or more blanket fastener portions attached thereto, the one or more first fastener portions configured to releasably engage the one or more first fasteners portions to form one or more respective clothing fasteners that releasably attach the blanket to the sleep sack, wherein:

the upper portion is configured to cover a child's torso, the upper portion including the neck opening and the first and second arm openings, the lower portion includes first and second leg sacks-configured to receive the child's respective legs, an interface of the upper and lower portions is configured to be aligned with the child's waist, the front side is configured to cover the child's anterior side, the back side is configured to cover the child's posterior side, the garment further comprises a longitudinal zipper attached to the sleep sack, the longitudinal zipper extending from at least the interface on the front side, along the lower portion on the front side, and along the lower portion on the back side to the interface on the back side, the longitudinal zipper including first and second sets of teeth, the first set of teeth attached to (a) the first leg sack along a length of the front and back sides of the first leg sack and (b) at least the interface of the front side, the second set of teeth attached to (a) the second leg sack along a length of the front and back sides of the second leg sack and (b) the interface of the front side, the sleep sack has a closed configuration in which the longitudinal zipper is fully closed to join the first and second legs sacks together to form a continuous compartment that fully encloses the child's respective legs, and the sleep sack has a car-seat configuration in which the longitudinal zipper is partially opened to release the first and second legs sacks from each other to allow the child's respective legs in the first and second legs sacks to separate to expose a groin buckle when the child is sitting in the child safety car seat thereby allowing the groin buckle to be fastened safely to a car seat harness without any interference from the sleep sack.

2. The garment of claim 1, wherein the one or more first fastener portions is/are attached to the front side of the sleep sack.

3. The garment of claim 1, wherein:

the sleep sack has a length that is measured with respect to a first axis that extends from the upper portion to the lower portion, the sleep sack has a width that is measured with respect to a second axis that is orthogonal to the first axis, the first and second arm openings spaced apart with respect to the second axis, and a width of the blanket is approximately equal to the width of the sleep sack.

4. The garment of claim 3, wherein the width of the sleep sack tapers from the lower portion to the upper portion.

5. The garment of claim 3, wherein the length of the blanket is less than the length of the sleep sack.

6. The garment of claim 5, wherein:

a first end of the blanket is aligned with the first and second arm openings, and a second end of the blanket is aligned with a bottom of the lower portion of the sleep sack.

7. The garment of claim 1, wherein the one or more respective clothing fasteners comprise at least one zipper, at least one set of hook-and-loop fasteners, at least one set of button fasteners, at least one set of magnetic fasteners, and/or at least one set of snap fasteners.

8. The garment of claim 1, wherein the sleep sack has an open configuration in which the longitudinal zipper is fully opened to remove the child from the sleep sack and/or place the child in the sleep sack.

9. The garment of claim 1, wherein the longitudinal zipper is attached to a center of the lower portion on the front and back sides of the sleep sack.

10. A garment configured for use with a child safety car seat, comprising:

a sleep sack having a front side, a back side, an upper portion, a lower portion, a neck opening, and first and second arm openings, wherein:

the upper portion is configured to cover a child's torso, the upper portion including the neck opening and the first and second arm openings, the lower portion includes first and second leg sacks configured to receive the child's respective legs, the front side is configured to cover the child's anterior side, the back side is configured to cover the child's posterior side, and an interface of the upper and lower portions is configured to be aligned with the child's waist, a longitudinal zipper attached to the sleep sack, the longitudinal zipper extending from at least the interface on the front side, along the lower portion on the front side, and along the lower portion on the back side to the interface on the back side, the longitudinal zipper including first and second sets of teeth, the first set of teeth attached to (a) the first leg sack along a length of the front and back sides of the first leg sack and (b) at least the interface of the front side, the second set of teeth attached to (a) the second leg sack along a length of the front and back sides of the second leg sack and (b) the interface of the front side, wherein:

the sleep sack has a closed configuration in which the longitudinal zipper is fully closed to join the first and second legs sacks together to form a continuous compartment that fully encloses the child's respective legs, and the sleep sack has a car-seat configuration in which the longitudinal zipper is partially opened to release the first and second legs sacks from each other to allow the child's respective legs in the first and second legs sacks to separate to expose a groin buckle when the child is sitting in the child safety car seat thereby allowing the groin buckle to be fastened safely to a car seat harness without any interference from the sleep sack; and one or more fastener portions attached to the sleep sack, the one or more fastener portions configured to releasably engage one or more respective blanket fastener portions on a blanket to form one or more respective clothing fasteners that releasably attach the blanket to the sleep sack.

11. The garment of claim 10, wherein the upper portion includes shoulder openings configured to allow the child to be removed from the sleep sack and/or to be placed into the sleep sack.

12. The garment of claim 11, further comprising shoulder fasteners configured to close and open the shoulder openings.

13. The garment of claim 10, wherein the one or more respective clothing fasteners comprise at least one zipper, at least one set of hook-and-loop fasteners, at least one set of button fasteners, at least one set of magnetic fasteners, and/or at least one set of snap fasteners.

14. The garment of claim 10, wherein:

the one or more fastener portions is/are one or more front fastener portions that are attached to the front side of the sleep sack, the one or more front fastener portions is/are configured to releasably engage one or more respective first blanket fastener portions on a first blanket to form one or more respective first clothing fasteners that releasably attach the first blanket to the front side of the sleep sack, and the garment further comprises one or more back fastener portions that is/are attached to the back side of the sleep sack, the one or more back fastener portions configured to releasably engage one or more respective second blanket fastener portions on a second blanket to form one or more respective second clothing fasteners that releasably attach the second blanket to the back side of the sleep sack.

15. The garment of claim 10, wherein:

the one or more fastener portions is/are one or more front fastener portions that are attached to the front side of the sleep sack, the garment further comprises one or more back fastener portions that is/are attached to the back side of the sleep sack, the garment has a first configuration in which the one or more front fastener portions releasably engage the one or more respective blanket fastener portions on the blanket to form one or more respective first clothing fasteners that releasably attach the blanket to the front side of the sleep sack, and the garment has a second configuration in which one or more back fastener portions releasably engage the one or more respective blanket fastener portions on the blanket to form one or more respective second clothing fasteners that releasably attach the blanket to the back side of the sleep sack.

16. The garment of claim 10, wherein the longitudinal zipper is attached to a center of the lower portion on the front and back sides of the sleep sack.

17. A kit comprising:

a garment configured for use with a child safety car seat, comprising:

a sleep sack having a front side, a back side, an upper portion, a lower portion, a neck opening, and first and second arm openings, wherein:

the upper portion is configured to cover a child's torso, the upper portion including the neck opening and the first and second arm openings, the lower portion includes first and second leg sacks configured to receive the child's respective legs, the front side is configured to cover the child's anterior side, the back side is configured to cover the child's posterior side, and an interface of the upper and lower portions is configured to be aligned with the child's waist, a longitudinal zipper attached to the sleep sack, the longitudinal zipper extending from at least the interface on the front side, along the lower portion on the front side, and along the lower portion on the back side to the interface on the back side, the longitudinal zipper including first and second sets of teeth, the first set of teeth attached to (a) the first leg sack along a length of the front and back sides of the first leg sack and (b) at least the interface of the front side, the second set of teeth attached to (a) the second leg sack along a length of the front and back sides of the second leg sack and (b) the interface of the front side, wherein:

the sleep sack has a closed configuration in which the longitudinal zipper is fully closed to join the first and second legs sacks together to form a continuous compartment that fully encloses the child's respective legs, and the sleep sack has a car-seat configuration in which the longitudinal zipper is partially opened to release the first and second legs sacks from each other to allow the child's respective legs in the first and second legs sacks to separate to expose a groin buckle when the child is sitting in the child safety car seat thereby allowing the groin buckle to be fastened safely to a car seat harness without any interference from the sleep sack;

and one or more first fastener portions attached to the sleep sack; and a blanket having one or more blanket fastener portions attached thereto, the one or more blanket fastener portions configured to releasably engage the one or more first fastener portions to form one or more respective clothing fasteners that releasably attach the blanket to the sleep sack.

18. The kit of claim 17, wherein:

the blanket is a first blanket, the one or more blanket fastener portions is/are one or more first blanket fastener portions, the one or more first fastener portions is/are one or more front fastener portions that are attached to the front side of the sleep sack, the one or more front fastener portions is/are configured to releasably engage the one or more respective first blanket fastener portions on the first blanket to form one or more respective first clothing fasteners that releasably attach the first blanket to the front side of the sleep sack, and the garment further comprises one or more back fastener portions that is/are attached to the back side of the sleep sack, the one or more back fastener portions configured to releasably engage one or more respective second blanket fastener portions on a second blanket to form one or more respective second clothing fasteners that releasably attach the second blanket to the back side of the sleep sack.

19. The garment of claim 17, wherein the longitudinal zipper is attached to a center of the lower portion on the front and back sides of the sleep sack.

* * * * *